US007204182B2

(12) United States Patent
Bouldin

(10) Patent No.: US 7,204,182 B2
(45) Date of Patent: Apr. 17, 2007

(54) APPARATUS FOR HEATING SPENT AMMUNITION CASES

(75) Inventor: Floyd E. Bouldin, McMinnville, TN (US)

(73) Assignee: Bouldin Corporation, Morrison, TN (US)

( * ) Notice: Subject to any disclaimer, the term of this patent is extended or adjusted under 35 U.S.C. 154(b) by 466 days.

(21) Appl. No.: 10/139,999

(22) Filed: May 8, 2002

(65) Prior Publication Data

US 2003/0138364 A1 Jul. 24, 2003

Related U.S. Application Data

(60) Provisional application No. 60/351,109, filed on Jan. 23, 2002.

(51) Int. Cl.
*F42B 33/00* (2006.01)
*F42B 33/06* (2006.01)

(52) U.S. Cl. ..... 86/49; 86/50; 422/163; 422/285

(58) Field of Classification Search ..... 110/241, 110/246; 202/81–83, 105, 108; 86/49, 50; 422/163, 285

See application file for complete search history.

(56) References Cited

U.S. PATENT DOCUMENTS 3,916,807 A * 11/1975 Eiki ..... 110/246
4,207,062 A * 6/1980 Moench et al. ..... 432/111
4,974,528 A * 12/1990 Barcell ..... 110/240
5,020,452 A * 6/1991 Rybak ..... 110/241
5,302,118 A * 4/1994 Renegar et al. ..... 432/14
5,827,012 A * 10/1998 Circeo, Jr. ..... 405/131
5,927,970 A * 7/1999 Pate et al. ..... 432/115

* cited by examiner

*Primary Examiner*—N. Bhat
(74) *Attorney, Agent, or Firm*—Waddey & Patterson, P.C.; Philip E. Walker; Edward D. Lanquist, Jr.

(57) ABSTRACT

An apparatus for destroying the volatility of propellant and primers associated with small arms ammunition which become inadvertently commingled with a supply of spent casings prior to material deformation and reclamation. The apparatus preferably includes three major sections or components and they are: a material infeed section, a heating section, and a material extraction section. The preferred infeed section includes a hopper placed in conjunction with an incline conveyor and a distally positioned dump chute. The heating section has a material receptacle in the form of a material receiving chute, a heater disposed adjacent to the interior of a longitudinal spirally internally veined rotating drum which communicates with the third section, which is a material extraction or expulsion section also in the form of an incline conveyor and a chute. The heater section includes a heater station which enables a supply of propane or LP gas to be connected thereto and ignited to fire heat the internal chamber of the rotating drum. The heating enables the propellant and primers associated with small arms ammunition casings or live rounds thereof which inadvertently become commingled with spent shell casings prior to the destruction and the material the reclamation process to be rendered inert.

27 Claims, 11 Drawing Sheets

APPARATUS FOR HEATING SPENT AMMUNITION CASES

This is application claims benefit of provisional application 60/351,109, filed Jan. 23, 2002.

BACKGROUND OF THE INVENTION

1. Field of the Invention

The present invention relates generally to apparatuses for heating ammunition casings to the point where the volatility of the propellant and primer associated therewith is destroyed in the event these components become inadvertently commingled with spent ammunition casings.

More specifically, the present invention relates generally to mobile or stationary apparatuses incorporating a heat source to raise the internal temperature of a heating chamber to render the propellant and primer of small arms ammunition inert.

2. Description of the Related Art

The present invention utilizes a heating chamber or vessel having a volume greater than the area of the so as to minimize the possibility of constraining an ammunition casing or placing it under pressure and thereby avoid a high velocity disassociation of the various components of small arms ammunition.

SUMMARY OF THE INVENTION

The present invention is a small arms ammunition certification apparatus intended to process spent ammunition casings prior to recycling and destroy the volatility of the propellant charge and primer associated with small arms ammunition (e.g. from handheld and small shoulder fired weapons such as a shotguns, pistols, revolvers and rifles) which becomes inadvertently commingled with the spent casings.

The invention can be stationary or mobile. The mobile embodiment includes a towable frame structure in the nature of a wheel mounted trailer with trailer hitch configuration suitable for engagement with a motorized vehicle enabling it to be towed from place to place.

The preferred embodiment of the present invention generally includes several distinct sections operably interconnected to carry out the certification of small arms ammunition casings. One of the sections includes a hopper and an inclined conveyor. The conveyor preferably further includes a series of spaced apart transverse flights positioned across the surface of the conveyor belt which enables the spent casings and ammunition that becomes inadvertently mixed therein to be carried upward and dumped into the next section which is the heating section and includes a heating chamber and burner station.

The heating section generates a high heat within the interior of a cylindrical chamber. The selected temperature is sufficient to ignite the propellant and primer and destroy their volatility. The high heat is preferably produced by a propane or LP gas flame blower configuration and is directed into the interior of a rotating steel cylinder. The flame blower creates heat that raises the internal temperature of the steel cylinder and the exterior of the steel cylinder is shielded to maintain the efficiency of the system.

When spent casings along with any ammunition inadvertently mixed therein is introduced into the cylinder of the heating section via an access chute having an inlet and a exit, the high heat causes the temperature of the ammunition propellant and primer to climb above its burning point but remain below the melting point of the metal components associated with the ammunition casings and bullets. The access chute allows the axial centerline of the cylinder to be offset from the end of the infeed conveyor and thus serves to shield the interior of the cylinder during use. When the powder charge and primer are rendered inert, the components can be separated. Thus separation enables the casing and bullets to be reclaimed for recycling once the casings and bullets exit the heating chamber and cool.

The cylinder further includes a series of internally projecting fins attached to its interior surface. The fins help move the small arms casings and unfired ammunition from the proximal end to the distal end of the rotating declined cylinder during use. The casings and any ammunition that becomes inadvertently mixed therein is processed during the migration along the interior of the cylinder. The cylinder also includes end plates which form flanges at the proximal and distal ends of the cylinder in order to reduce the size of the interior opening to the cylinder and assist with the efficient heating and processing of the cases. An annular ring like flange is also provided adjacent the distal end of the cylinder and protrudes into it to enable the casings exiting the cylinder to be carefully removed without spilling from the cylinder. The annular flange(s) also enable the cylinder to maintain its proper operational alignment atop the declined frame on which it rotates during use.

Yet another section follows the heating section and preferably includes a hopper which collects the brass casings and bullets (i.e., components of spent and live ammunition) which are within the heating chamber and carries them from the heating chamber via an exit chute. The exit chute is placed adjacent to an inclined take-away conveyor which is used to carry the brass casings and bullets upwardly and out of the confines of the machine for cooling.

Of course, some considerations must take advantage of the relative height relationship between the first incline conveyor in the preferred embodiment and the dump height of the conveyor with reference to the proximal input flanged and of the rotating cylinder. It is preferred that a variance in height is presented in the event the casing or projectile portion of the small arms ammunition being rendered inert within the cylinder is fired and the casing or projectile are propelled by the force. Because there is no chamber pressure for the small arms ammunition, like that associated with a firearm, the casing and projectile are propelled at a high velocity and thus do not destroy the apparatus.

In addition, a metal, preferably stainless steel heat resistant cover overlies the combination of the steel cylinder and a heat absorbing blanket both of which turn underneath the cover. The cover is provided as a means to insulate the cylinder and reduce the temperature to the touch. The underside of the cover is preferably lined with a heat resistant insulating blanket which further has a tendency to resist heat transfer, enhance the efficiency of the rotating steel cylinder by trapping the heat inside of the heating chamber and therefore surrounding the blanket from which the high heat has a tendency to attempt to escape. Between the blanket and the cylinder is an air space between the blanket and the heat absorbing insulating material forming the underside of the preferably aluminum cover.

The preferred embodiment of the mobile version of the present invention positions all three of the primary components on an axled trailer as mentioned above. The axled trailer enables the apparatus to be taken to and removed from the firing ranges at military installations thereby making the processing of the small arms ammunition casings more efficient as it is known that live rounds have and do become commingled with the spent shell casings. The casing must be processed prior to mechanical deformation to prevent reloading yet enable them to be included within the materials reclamation process of the base or installation prior to their removal therefrom.

The present invention may be summarized in a variety of ways, one of which is the following: an apparatus for destroying the volatility of propellant and primers associated with small arms ammunition prior to their destruction and deformation in the materials reclamation process, comprising, at least one hopper, conveyor means for transporting the casings to be processed, and a heating chamber assembly further comprising a burner station, a casing infeed section and a casing removal section.

The perferred embodiment preferably further comprises a trailer portion supporting the at least one hopper, the conveyor means and the heating chamber. The conveyor means further includes at least one inclined conveyor having a proximal and distal end, and the heating chamber assembly further includes a heating cylinder and means for rotating the heating cylinder during use.

The preferred embodiment also includes means for supporting the heating cylinder in a declined position such that the infeed section of the heating cylinder is higher than the casing removal section, and preferably includes roller means for maintaining the proper alignment of the cylinder in the proper heating cylinder.

The preferred embodiment also includes means for preventing the casings from escaping the heating chamber assembly at the casing removal section thereof, and preferably includes a cooperating circumferential plate and annular collar assembly.

The interior of the heating chamber has spiral flutes to help move the casings from a proximal end to a distal end within the cylinder during use.

An advantage of the present invention is the ability to destroy the volatility of propellant and primer charges associated with small arms ammunition which becomes inadvertently commingled and mixed within a quantity of spent shell casings. As the spent shell casings are deformed to enable them to enter the materials reclamation cycle certain steps must be taken to safeguard the integrity of the materials reclaimed such that any and all live rounds are destroyed prior to the deformation process.

An object of the present invention is to provide an apparatus for efficiently destroying and rendering inert small arms ammunition which becomes inadvertently commingled and mixed within a supply of small arms ammunition casings prior to their destruction and deformation and thus materials reclamation.

A feature of the present invention is a heating chamber which preferably comprises a rotating, internally heated, steel cylinder.

An advantage of the present invention is to provide a rotating steel cylinder the internal confines for which the small arms ammunition and brass shell casings travel during the heating process and therefore during the step by which the propellant and primers of the small arms ammunition which becomes inadvertently commingled in the casing supply prior to materials reclamation is heated.

An object of the present invention is to provide an apparatus for effectively receiving and conveying a quantity of small arms ammunition as well as small arms ammunition cases in the same material hopper in the same manner in which they are conveyed to ensure the live rounds which become inadvertently commingled with the aforementioned spent shell casings the volatility for which is destroyed and become readily available then for materials reclamation.

It is a feature of the present invention to provide a preferred incline conveyor with associated hopper at the inlet of the heating section, interposition the heating section between (a) the infeed conveyor and an incline exit conveyor so as to off-center the input ports and exit ports of the heating section such that in the rare occurrence of a discharge of a projectile within the heating cylinder the projectile's momentum must be slowed and in fact reversed in order for it to escape from the inlet port and exit ports thereof.

DETAILED DESCRIPTION OF THE PREFERRED EMBODIMENTS

Figure 1A:
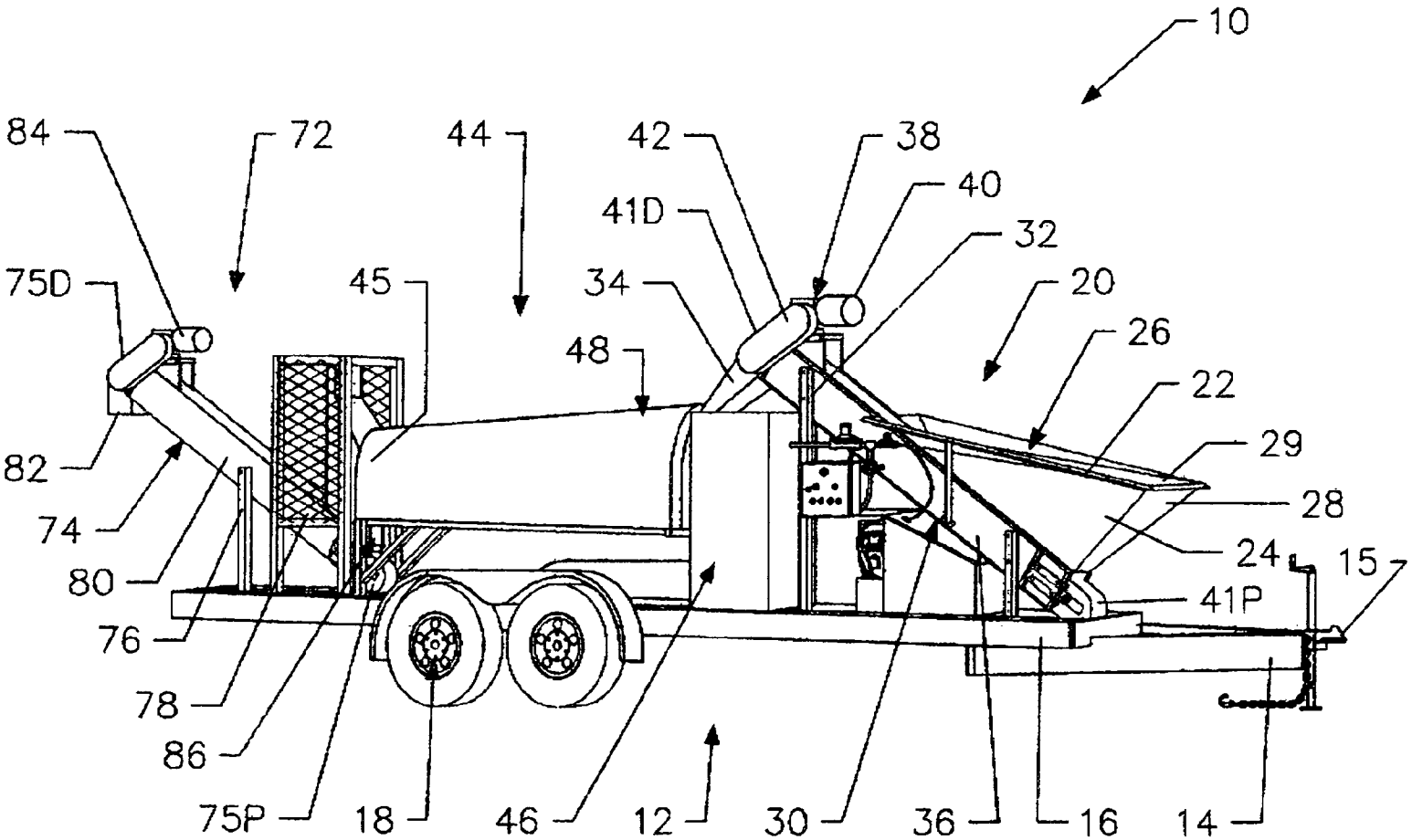
FIG. 1A is an elevated perspective view of the preferred embodiment of the present invention.

With reference to FIG. 1A, a preferred embodiment of the present invention is designated generally by the reference numeral 10 and includes several sections or subassemblies which can be distinguished from one another by the function or operation of the components shown as designated therein and hereinbelow.

Figure 1B:
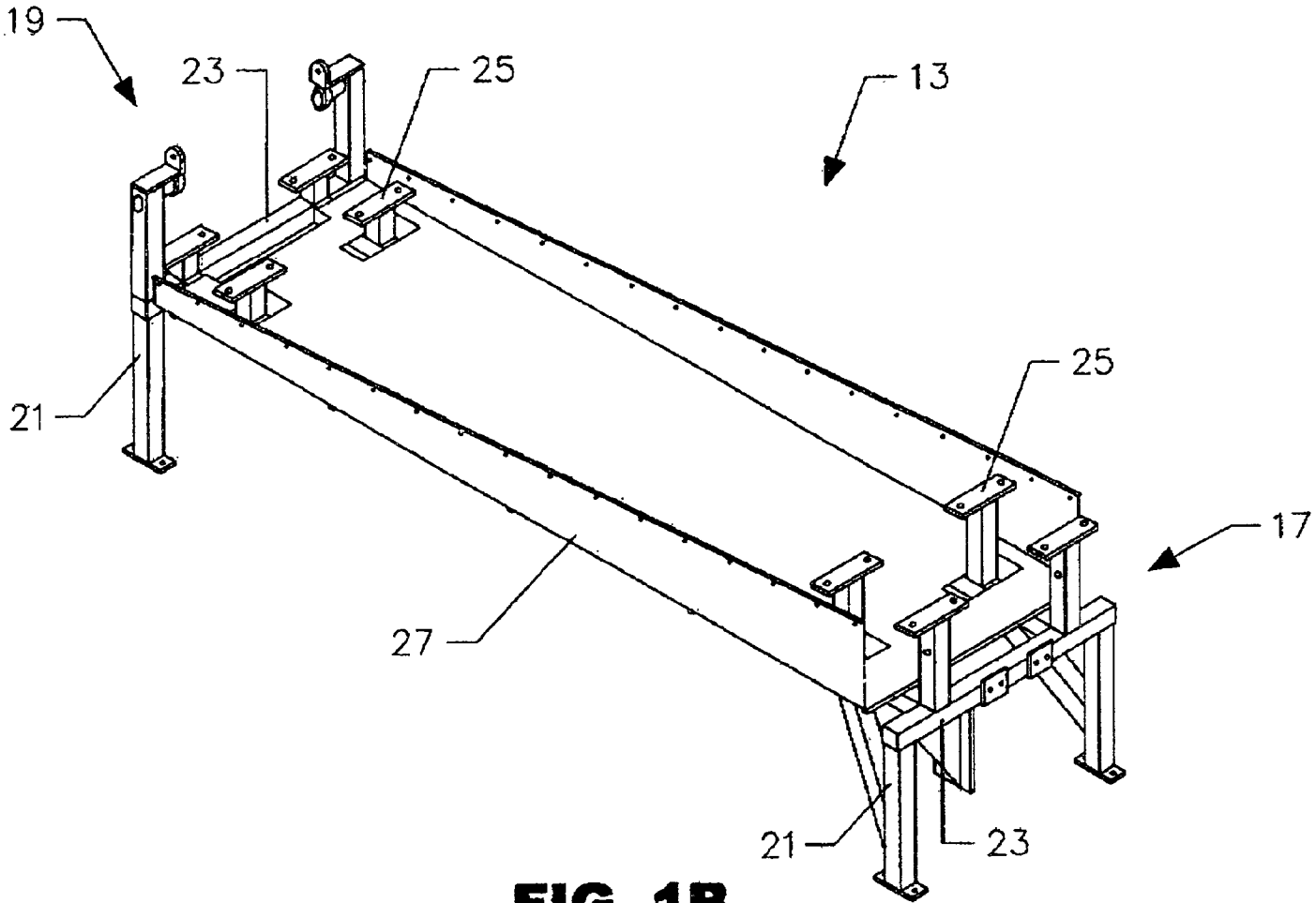
FIG. 1B is an elevated perspective view of the frame portion of the preferred embodiment of the present invention as shown in FIG. 1.

A trailer portion, designated generally by the reference numeral 12 incorporates a trailer tang 14 with hitch connection 15, attached to a trailer bed portion 16 having wheeled axles 18 for mobility. The trailer portion 12 also includes a heating chamber frame assembly designated generally by the reference numeral 13 of FIG. 1B.

Frame assembly 13 has spaced apart ends 17 and 19, a plurality of upright vertical supports 21, horizontal frame members 23, bearing supports 25, and a frame cover 27. The bearing supports 25 differ in vertical height in order to provide an imaginary declined plane from end 17 toward end 19 for optimum operable support of the heating chamber section 48 more thoroughly described below.

A casing infeed section, designated generally by the reference numeral 20 in FIG. 1A, includes a material hopper 22 having beveled side walls 24, an interior well 26, a beveled front wall 28, which presents an upper hopper opening 29 to allow the ammunition casings (not shown) to be easily dumped within the hopper well 26 for processing.

In use, the hopper 22 is positioned adjacent to and/or supported by an inclined conveyor designated generally be the reference numeral 30, the proximal end 41P of which is in operable relationship with a hopper opening (not shown) in the bottom of the hopper 22. Inclined conveyor 30 is supported by upright supports 32 attached to the sides 36 of the conveyor and the trailer bed 16 referred to above. Exit chute 34 is directed downwardly and away from the distal end 41D opposite end 41P such that casings entering the hopper 22 are carried upward on a conveyor belt (not shown) interpositioned between the sides 36 of the inclined conveyor 30.

The conveyor belt is powered by a motor assembly 38 further preferably comprising an electric motor 40 positioned about a conventional roller shaft (not shown) to drive the conveyor belt upwardly from the proximal end 41P to the distal end 41D and in alignment with the exit chute 34 which directs the casings from the conveyor 30 into the heating chamber section designated generally by the reference numeral 44. A drive axle cover 42 is positioned adjacent one of the sides 36 of the incline conveyor 30 to help minimize the possibility of inadvertent user contact with the components which rotate and turn therebelow.

The heating chamber section 44 is further comprised of a burner station 46, a heating cylinder station 48, and a casing exit station 86 associated with the casing removal section of the invention designated generally by the reference numeral 72.

The casing removal section 72 includes an inclined conveyor similar to the one described as conveyor 30 and is designated generally by the reference numeral 74. The inclined conveyor 74 has a proximal and distal end 75P and 75D respectively. Proximal end 75P is positioned adjacent to the casing exit station 86 of the heating section 44.

After the small arms ammunition cases are heated (i.e., processed) within the heating section 44 they are expelled therefrom by rotational migration from the entrance of the heating cylinder station 48 to the exit station 86 and are received by the removal section 72 near the proximal end 75P of the inclined conveyor 74.

Upright frame supports 76 enable the incline conveyor 74 to be angled upwardly and away from the exit end 45 of the heating chamber section 44. In addition, cage 78 provides additional means but not total isolation from the exit end 45 because of the high temperatures associated with the processed casings.

Inclined conveyor 74 further includes spaced-apart sides 80 only one of which is shown in the figure, an ejection port 82 positioned at the distal end 75D. Small arms brass ammunition casings are moved along a conveyor belt (not shown) upwardly and away from the heating exit section 45 and is expelled through the chute 82 onto the ground or into some other user provided receptacle.

Motor 84 is preferably electric and similar to that designated as motor 40 with respect to the infeed section 20. It provides the rotational force to the roller bearing (not shown) sufficient to move the conveyor belt (not shown) and carry the spent casings. Cartridge deflecting baffle 86 may include an optional hinged door (see FIGS. 6A and 6B) enabling the heated ammunition casings that exit the heating section 44 to be carried away by the conveyor 74 as described.

Figure 2A:
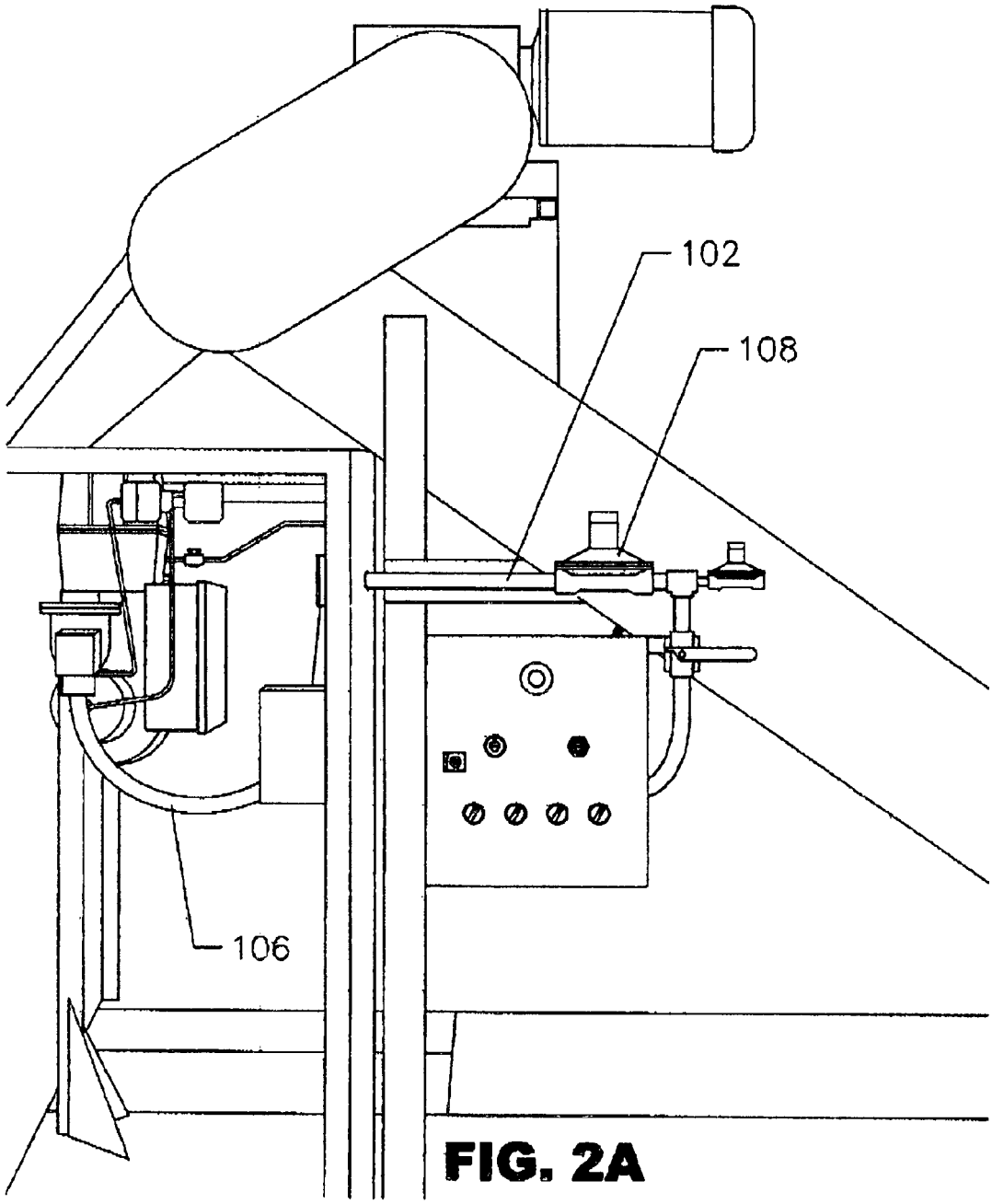
FIG. 2A is an elevated perspective view of the left side of the conveyor infeed section of the preferred embodiment shown in FIG. 1.
Figure 2B:
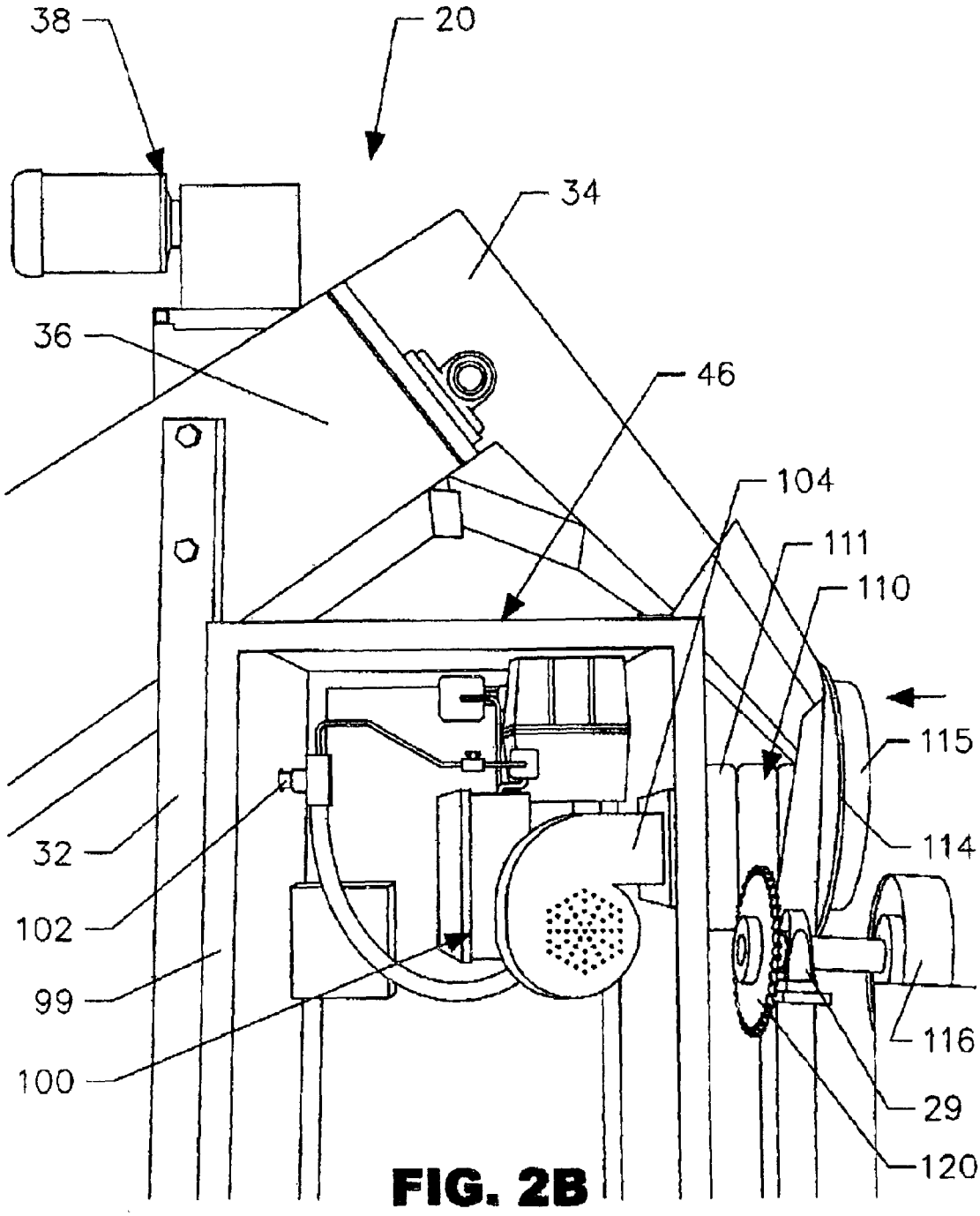
FIG. 2B is an elevated perspective view of the right side of the conveyor infeed section of the preferred embodiment shown in FIG. 1 and opposite the left side as shown in FIG. 2A.
Figure 5:
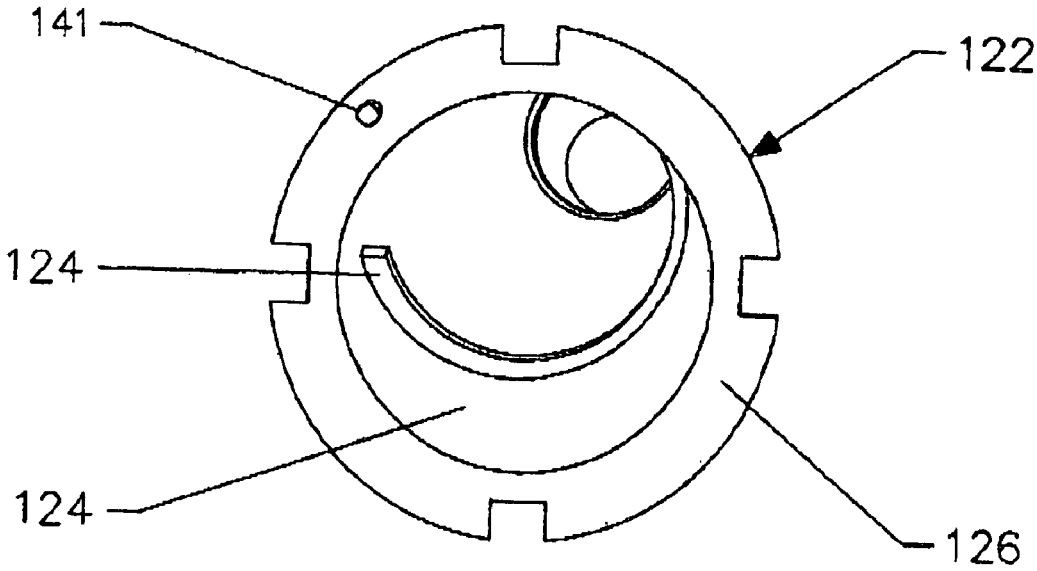
FIG. 5 is an elevated perspective end view of the heating cylinder of the preferred embodiment of the present invention.

With reference to FIGS. 2A and 2B, burner station 46 includes a vertical cabinet type housing 99 covering a variety of heating components including a heater assembly designated generally by the reference numeral 100. Heater assembly 100 further includes gas supply line 102 connected to an external supply of flammable gas (e.g., natural gas or propane) but not shown. Supply lines 102 and 106 further includes gas regulator(s) 108 to throttle the flow and pressure of the flammable gas into the burner 100. The exhaust of the burner is heat which is moved by blower 104 which is positioned opposite the vent assembly 110. The preferred embodiment of the vent assembly 110 is covered by an insulating blanket 111 enabling the heated exhaust from the burner to be blown into the interior of the heating chamber 124 (FIG. 5) during use.

With reference to FIGS. 2B, 3A, 3B, 4 and 5, the chute 34 is shown having an exit port 112, a circumferential plate 114, and an annular collar 115 which surrounds the exit port 112. The combination of the plate 114 and collar 115 and are sized to correspond to the relative dimensions of the end plate 126 and interior 124 of the heating cylinder 122 of FIG. 5.

The heating cylinder 122 is operably supported wheels 116 fitted to shafts 118 and held in proper alignment by bearing supports 25. The bearing supports 25 and the guide rollers 135 of FIGS. 6A and 6B maintain the heating cylinder in proper elevation above the frame 13 and axial position with respect to the exit end ring 130 (FIG. 6B).

Figure 3A:
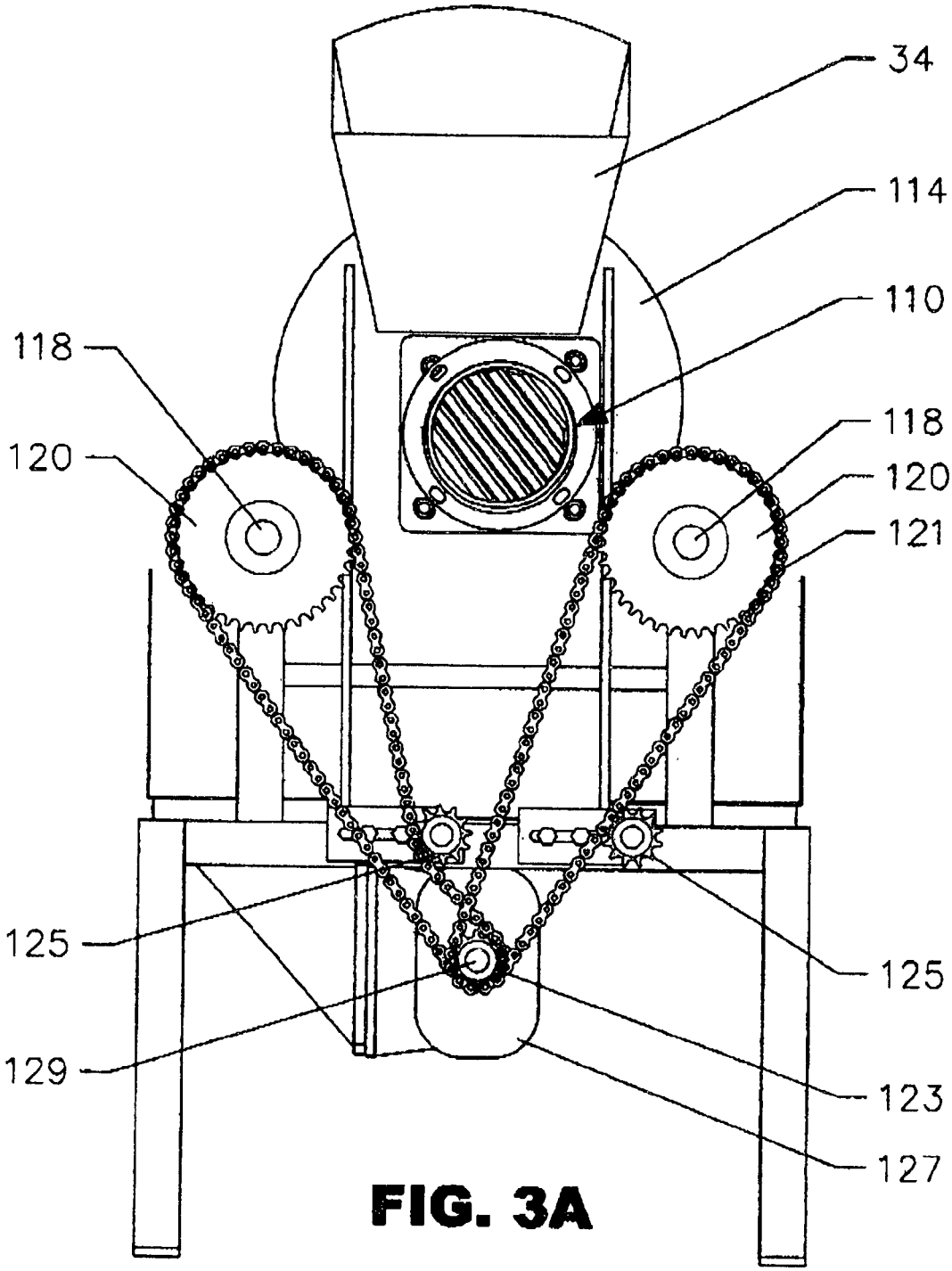
FIG. 3A is a rear plan view of the heating section of the preferred embodiment taken in the direction opposite the arrow shown in the right hand margin of FIG. 2B.
Figure 3B:
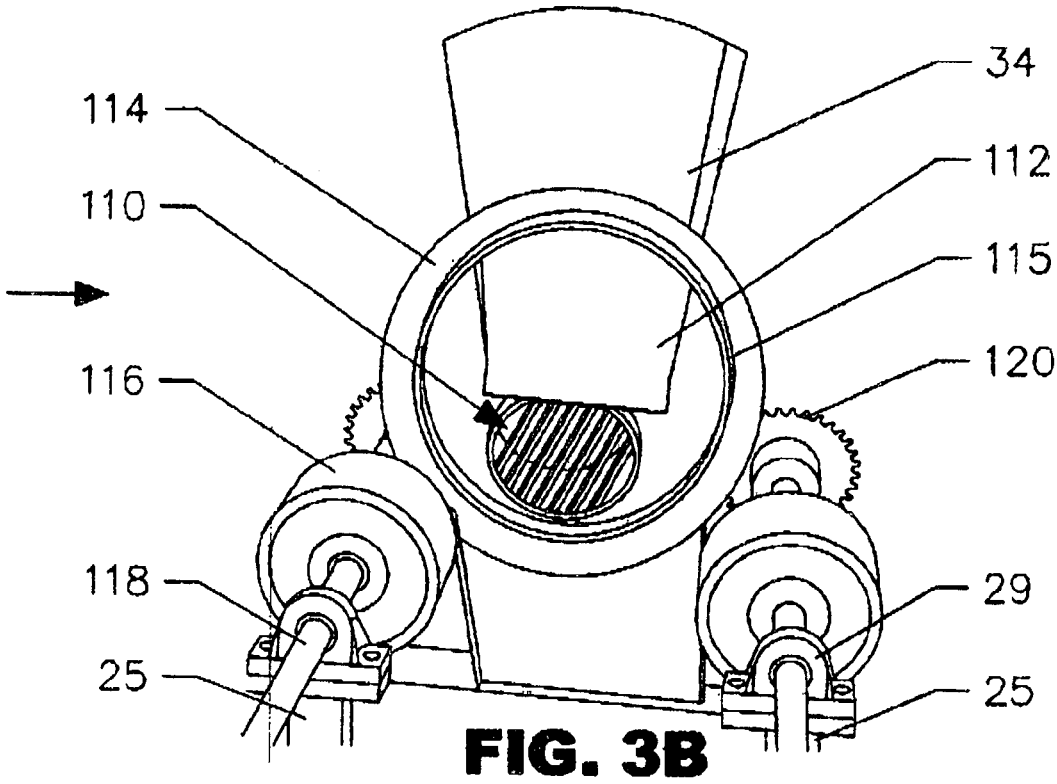
FIG. 3B is an elevated perspective view of the heating section of the preferred embodiment taken in the direction of the arrow shown in the right hand margin of FIG. 2B.

With specific reference to FIGS. 3A and 3B, roller drive motor 127 has a motor shaft 129 fitted with drive sprocket 123. Chain 121 is laced onto the drive sprocket 123 and interlaced between tension sprockets 125 and cylinder drive sprockets 120. In use with the heating cylinder 122 having roller bearing surface 131 resting on the cylinder rollers 116 and against the guide rollers 135 (FIG. 8), the motor 127 imparts a rotational torque to the shaft 129 which then rotates the drive sprocket affixed thereto. Chain 121 turns the roller sprockets 120 in the same direction as the chain 121 is interlaced around them. Tensioners 125 take up the slack in the chain and are adjustable to compensate for the stretching of the chain over prolonged use.

Figure 4:
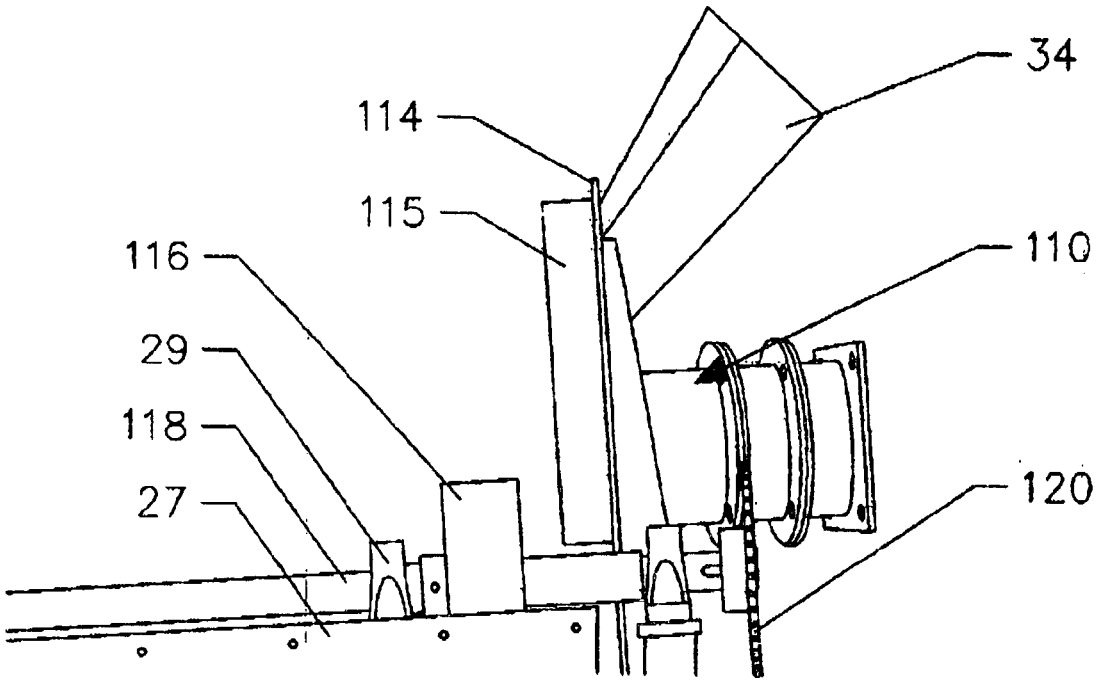
FIG. 4 is an elevated perspective side view of the components shown opposite or behind those shown in FIG. 3B and taken in the direction of the arrow in that figure.
Figure 8:
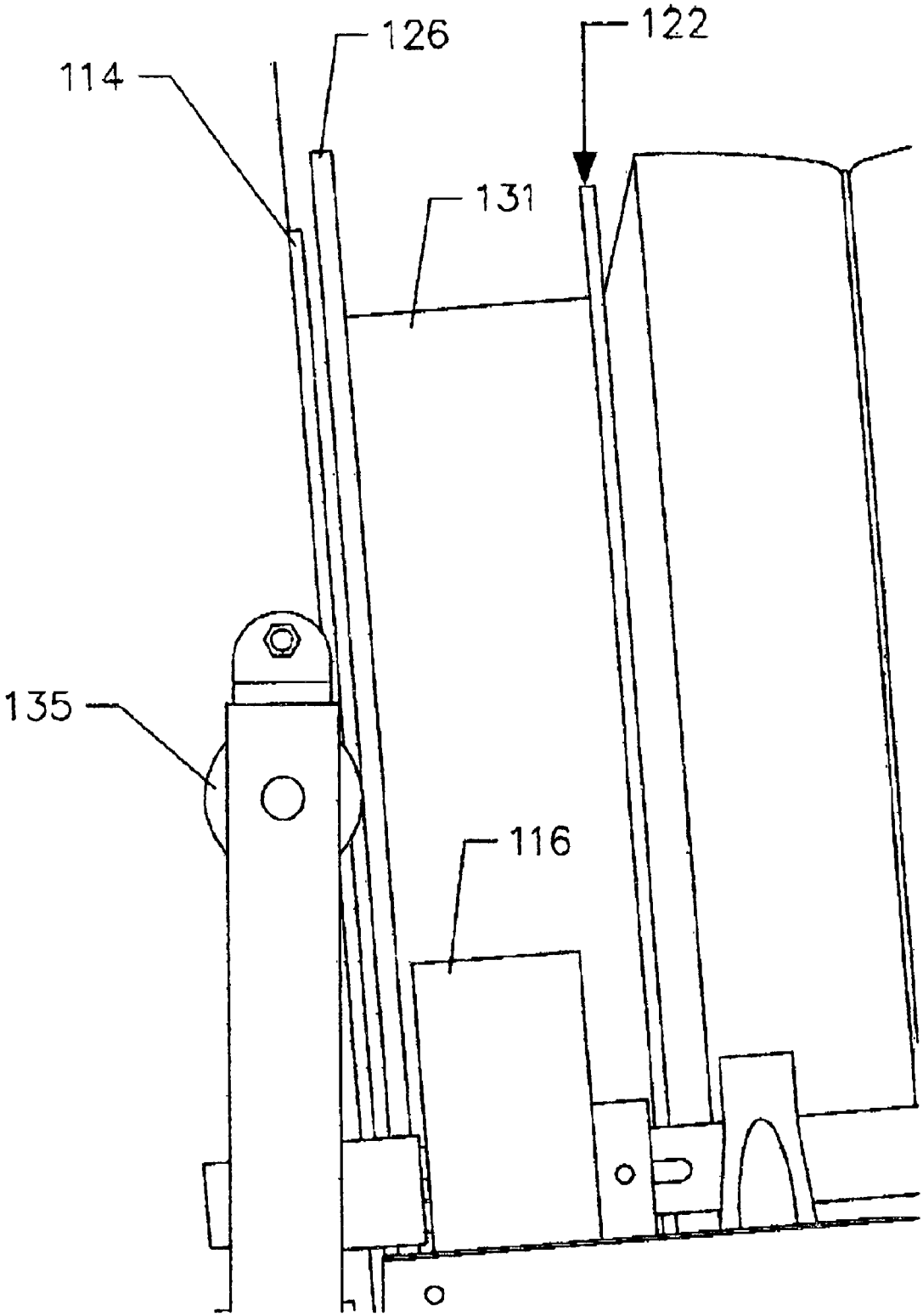
FIG. 8 is a side plan view of a portion of the means for preventing casings from escaping the heating cylinder and including cooperating circumferential plate and annular collar assembly.

The heating cylinder 122 is made of steel and has an internal chamber 124 and has spiral flutes 128, an external flanged end plate 126 having optional cutouts 133 or optional proximity peg 135 either of which allows the user to monitor the rotation of the cylinder 122 as properly rotating beneath the cover 146 which is provided to mate in close conjunction with plate 114 of FIGS. 3B, 4 and 8.

Blanket 142 is fastened around the exterior surface of the cylinder by band type fasteners 144 which resist high temperatures (e.g., wire, flexible hose clamps, metal banding, etc.). The blanket 142 is made from a high temperature resistant fabric or asbestos material, and is provided to insulate the cylinder from heat loss and improve efficiency.

In use, when heat is introduced into the interior of the steel cylinder 122 via the burner blower 104 through the vent assembly 110, the expansion of the steel cylinder 122 takes up the separation distance and space between plates 126 and 114 (FIG. 8) and guide rollers 135 help maintain the proper separation distance despite thermal expansion. The rotation of the cylinder is believed necessary to cause the casings to migrate from one end of the cylinder 122 to the exit end 45 (FIG. 1).

During operation the interior of the cylinder is approximately one thousand six hundred degrees (1600°) and the temperature of the casings exiting therefrom is approximately nine hundred degrees (900°). These temperature have shown to be adequate to cause the powder charge and active primer materials associated with small arms ammunition to burn and thus render the ammunition inert by the disassociation of the components during the heating and firing processes. Unfired ammunition casing which become inadvertently commingled with the spent casings are then "fired" within the interior 124 of the cylinder 122 to render them inert and separate the components (e.g., projectile from casing). The spiral flutes 128 assist with the migration of the casings.

Figure 6A:
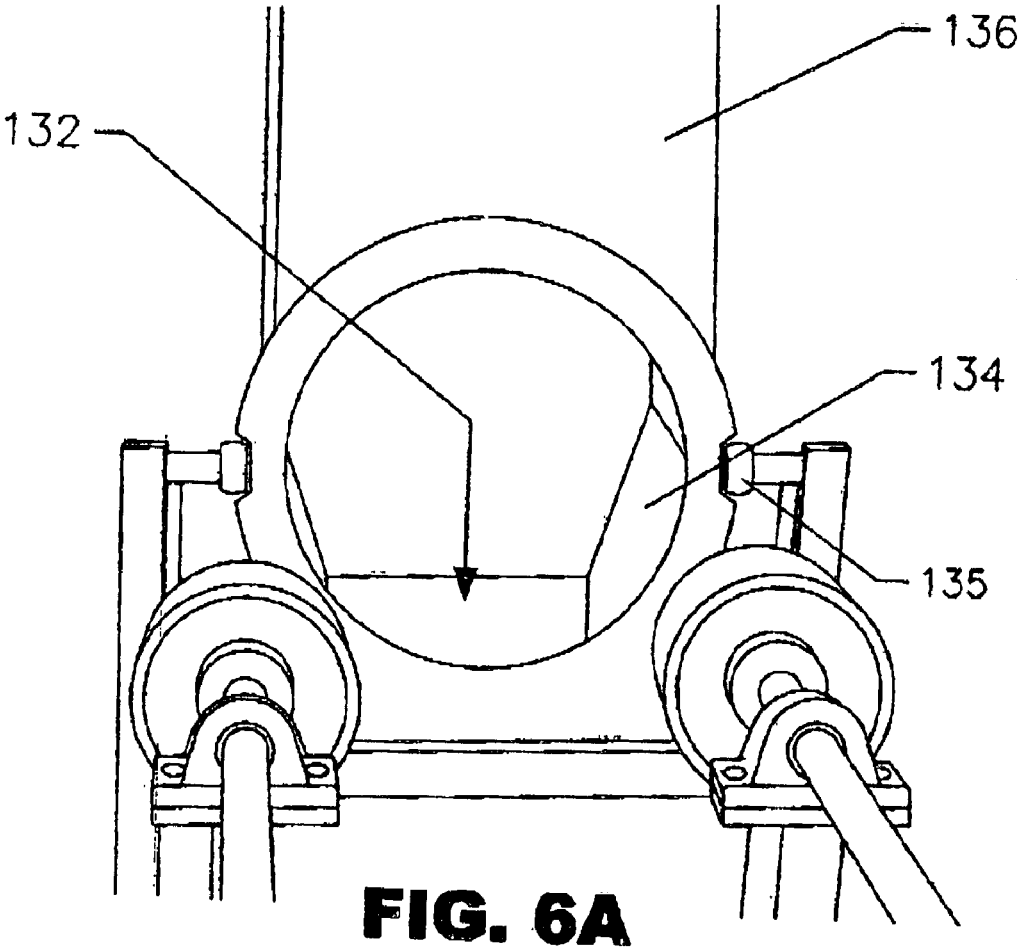
FIG. 6A is an elevated perspective view of the casing removal chute of the present invention shown with an exit port substantially the same size as the cylinder diameter shown in FIG. 5.
Figure 6B:
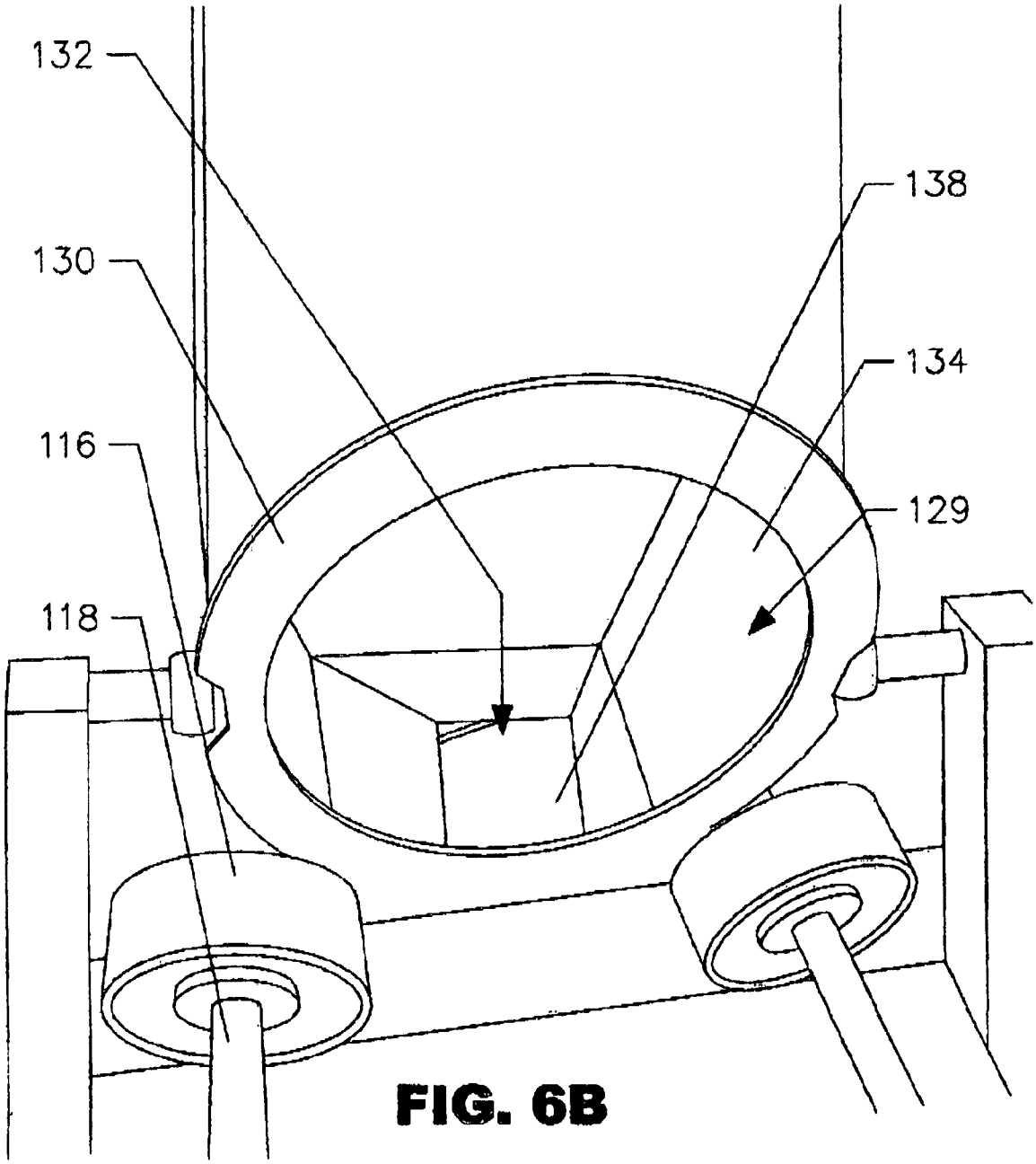
FIG. 6B is an elevated perspective view of the shell casing removal chute of the present invention shown with an exit port opening having an optional trap door and having an exit port substantially the same size as the cylinder diameter shown in FIG. 5.
Figure 7:
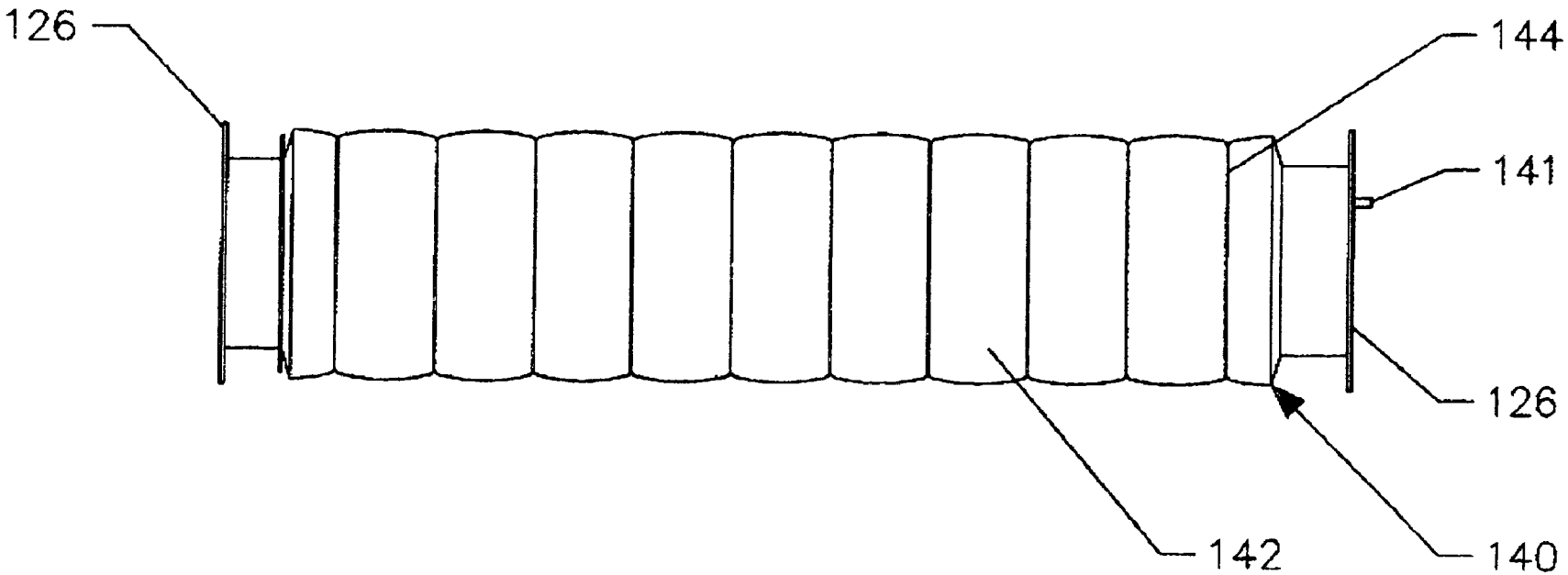
FIG. 7 is a side elevated perspective view of the heat blanket surrounding the heating cylinder.

With reference to FIGS. 6A and 6B, exit opening 132 further includes angled walls 134 and chute 136. The optional trap door 138 is operably configured to enable the weight of the heated to push it open against its biasing force enabling the casings to fall freely therethrough and be expelled from the cylinder 122. Chute 136 directs the casings from the cylinder to the exit 132.

Figure 10:
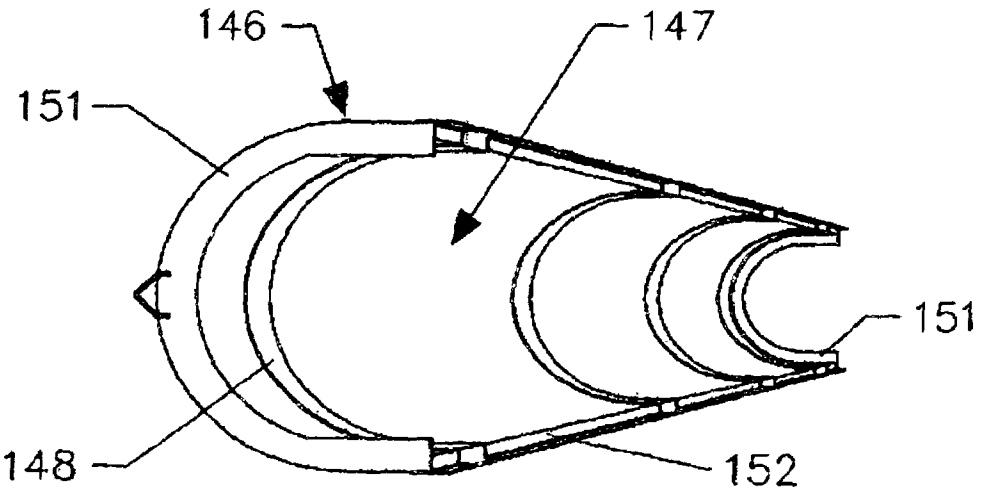
FIG. 10 is an elevated perspective view of the underside surface of the cover shown in FIG. 9.
Figure 9:
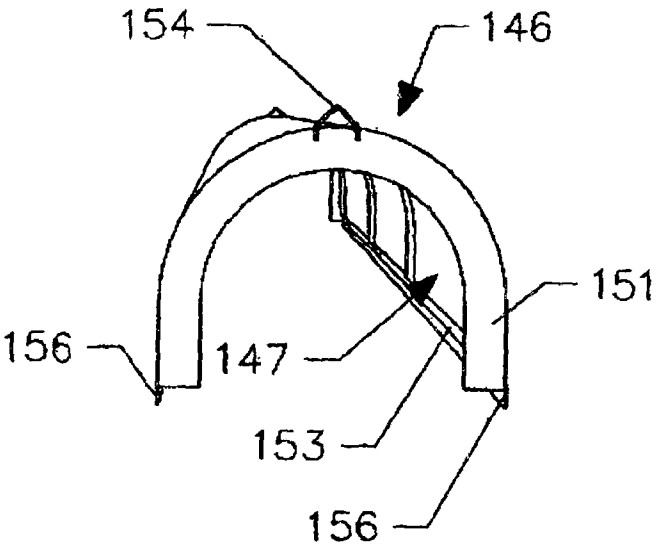
FIG. 9 is an elevated perspective end view of the cover shown in FIG. 1A complete with hanger brackets which facilitates the removal of the cover from the machine.

With reference to FIGS. 9 and 10, a cover or shield component is designated generally by the reference numeral 146. Cover 146 includes an arcuate body 147 and interior reinforcing ribs 148 to maintain its curved shape and secure the insulation 152 to the interior surface 153 of the cover 146. The insulating material 152 allows the material to reflect heat inwardly back toward the cylinder blanket therefore helping to maintain the overall efficiency of the operating temperatures established within the cylinder. The cover 146 also includes end flanges 151 and side flanges 156 enabling the cover to also serve as a shroud or cowling to further minimize inadvertent contact with the heated surface. Optional hangers 154 are provided as a lifting mechanisms of the cover such that what is potentially cumbersome is now easily managed by a sling arrangement fitted to the hangers 154 positioned at each end (only one of which is shown), to facilitate easy removal thereof.

These and other embodiments of the present invention shall become apparent after consideration of the scope of the specification, drawings, and claims set forth herein. All such embodiments and equivalents thereof are contemplated to be covered by and within the scope of the claims appended hereto, even though not specifically set forth herein due to the limitation of space.

What is claimed is:

1. An apparatus for destroying the volatility of propellant and primers associated with small arms ammunition casings prior to their destruction and deformation in the materials reclamation process, comprising:

at least one hopper for holding the ammunition casings to be processed, conveyor means for transporting the ammunition casings from the hopper to a heating chamber assembly for processing the casings; and the heating chamber assembly further comprises a burner station, a heating cylinder having a diameter and positioned to receive heat from the burn station and to receive the ammunition casings, a vent assembly between the burner station and the heating chamber; and an ammunition casing removal section including an exit port substantially the same size as the cylinder diameter.

2. The apparatus of claim 1, further comprising:

a trailer for supporting the at least one hopper, conveyor means and heating chamber.

3. The apparatus of claim 1, wherein the conveyor means further includes:

at least one inclined conveyor having a proximal and distal end.

4. The apparatus of claim 1, wherein the heating chamber assembly further comprises:

an ammunition casing infeed section, and a heating cylinder.

5. The apparatus of claim 4, further comprising:

means for rotating the heating cylinder during use.

6. The apparatus of claim 4, further comprising:

means for supporting the heating cylinder in a declined orientation with respect to the ammunition casing removal portion such that the infeed portion of the heating cylinder vertically higher than the casing removal portion.

7. The apparatus of claim 1, further comprising:

means for preventing casing from escaping the heating chamber assembly at the ammunition casing removal section thereof.

8. The apparatus of claim 4, further comprising:

means for preventing the ammunition casings from escaping the heating chamber assembly at the casing infeed section which further comprises a cooperating circumferential plate and annular collar assembly interpositioned between the heating cylinder and the casing infeed section.

9. The heating cylinder of claim 4, wherein the heating cylinder further comprises:

an interior surface having spiral flutes protruding therefrom and provided to help move the ammunition casings from a proximal end to a distal end within the cylinder during use.

10. The apparatus of claim 4, further comprising:

roller means for maintaining the proper operational alignment of the heating cylinder.

11. An apparatus for destroying the volatility of propellant and primers associated with small arms ammunition casings prior to their destruction and deformation in the materials reclamation process, comprising:

a heating chamber assembly for processing spent ammunition casings; and the heating chamber assembly further comprises, a burner station, a rotatable heating cylinder, a vent between the heating cylinder and the burner station for transmitting the heat from the burner station into the heating cylinder, a casing infeed section, and a casing removal section, wherein a majority portion of the rotatable heating cylinder is positioned between the burner station and the ammunition casing removal section.

12. The apparatus of claim 11, further comprising:

a trailer for supporting the heating chamber.

13. The apparatus of claim 11, wherein the conveyor means further includes:

at least one inclined conveyor having a proximal and distal end placed adjacent to the ammunition casing infeed portion.

14. The apparatus of claim 11, wherein the heating chamber assembly further comprises:

at least one inclined conveyor having a proximal and distal end placed adjacent to the ammunition casing removal portion.

15. The apparatus of claim 14, further comprising:

means for rotating the heating cylinder during use.

16. The apparatus of claim 15, further comprising:

means for supporting the heating cylinder in a declined orientation with respect to the ammunition casing removal portion such that the infeed portion of the heating cylinder vertically higher than the ammunition casing removal portion.

17. The apparatus of claim 11, further comprising:

means for preventing casing from escaping the heating chamber assembly at the casing removal section thereof.

18. The apparatus of claim 11, further comprising:

means for preventing the ammunition casings from escaping the heating chamber assembly at said casing infeed section which further comprises a cooperating circumferential plate and annular collar assembly interpositioned between the heating cylinder and said casing infeed section.

19. The heating cylinder of claim 11, wherein the heating cylinder further comprises:

an interior surface having spiral flutes protruding therefrom and provided to help move the casings from a proximal end to a distal end within the cylinder during use.

20. The apparatus of claim 11, further comprising:

roller means for maintaining the proper operational alignment of the heating cylinder.

21. An apparatus for heating ammunition cartridges using a heat source comprising:

a heating chamber, the heating chamber further comprising an infeed section for receiving the ammunition cartridges and an exit opening for discharging the ammunition cartridges, a heating cylinder having an internal chamber for receiving the ammunition cartridges and for receiving heat from the heat source, the internal chamber including at least one longitudinally spiral vein, the heating cylinder and the infeed section positioned to define a gap whereby the gap is reduced as the heating cylinder expands during use; and means for directing heat from the heat source into the internal chamber while preventing a flame from the heat source from entering the internal chamber.

22. The apparatus of claim 21 wherein the means for directing heat from the heat source into the internal chamber while preventing a flame from the heat source from entering the internal chamber comprises:

a vent assembly.

23. The apparatus of claim 21 wherein the means for directing heat from the heat source into the internal chamber while preventing a flame from the heat source from entering the internal chamber comprises:

an insulation blanket.

24. The apparatus of claim 21 wherein the means for directing heat from the heat source into the internal chamber while preventing a flame from the heat source from entering the internal chamber is gaseously connected to the heat source.

25. An apparatus for heating ammunition cartridges comprising:

a burner station for creating heat;

a heating cylinder having an interior;

a vent assembly receiving heat from the burner station and directing heat to the heating cylinder, the vent preventing flame from the burner station from entering the interior; and a blower operatively attached between the burner station and the heating cylinder for moving heat from the burner station through the vent assembly and into the interior.

26. An apparatus for heating ammunition cartridges comprising:

a burner station for creating heat;

a heating cylinder having an interior, an entry end proximate the burner station, and an exit end opposite the entry end;

a vent assembly receiving heat from the burner station and directing heat to the heating cylinder, the vent preventing flame from the burner station from entering the interior;

an insulation blanket between the burner station and the heating cylinder and enclosing the vent assembly ; and a blower for moving heat from the burner station through the vent assembly and into the interior.

27. An apparatus for heating ammunition cartridges comprising:

a burner station for creating heat;

a heating cylinder having an interior chamber, an entrance end, and an exit end positioned opposite the burner station, the exit end including a biasing door;

a vent assembly fluidly connecting the burner station to the heating cylinder for receiving heat from the burner station and directing heat to the interior chamber, the vent preventing flame from the burner station from entering the interior chamber;

a blower operatively attached between the burner station and the heating cylinder for moving heat from the burner station through the vent assembly and into the interior; and an insulation blanket located between the burner station and the heating cylinder.

* * * * *